United States Patent [19]

Sixsmith

[11] Patent Number: 5,074,751

[45] Date of Patent: Dec. 24, 1991

[54] FAN CASING

[75] Inventor: Richard Sixsmith, Mississauga, Canada

[73] Assignee: Plasticair Inc., Canada

[21] Appl. No.: 526,288

[22] Filed: May 21, 1990

[30] Foreign Application Priority Data

May 23, 1989 [CA] Canada ..... 600443

[51] Int. Cl.[5] ..... F01D 9/00

[52] U.S. Cl. ..... 415/206; 415/204; 415/211.2; 415/214.1

[58] Field of Search ..... 415/206, 200, 213.1, 415/214.1, 203, 204, 208.1, 211.2, 126, 127

[56] References Cited

U.S. PATENT DOCUMENTS

| | | | |
|---|---|---|---|
| 1,355,982 | 10/1920 | La Bour | 415/204 |
| 1,483,995 | 2/1924 | Taylor | 415/214.1 |
| 1,707,719 | 4/1929 | Goldthwaite | 415/204 |
| 1,778,015 | 10/1930 | Becker | 415/126 |
| 1,791,170 | 2/1931 | Schuchardt | 415/126 |
| 2,450,671 | 10/1948 | Loss . | |
| 2,452,274 | 10/1948 | Walters | 415/211.2 |
| 2,942,773 | 6/1960 | Eck . | |
| 3,301,472 | 1/1967 | Dixon et al. . | |
| 3,552,876 | 1/1971 | Updike . | |
| 3,607,600 | 9/1971 | Schreter et al. . | |
| 3,656,861 | 4/1972 | Zagar | 415/204 |
| 3,797,961 | 3/1974 | Brechbuhl . | |
| 4,113,407 | 9/1978 | Grzina . | |
| 4,406,583 | 9/1983 | Becker et al. . | |
| 4,450,755 | 5/1984 | Catan | 415/206 |
| 4,599,042 | 7/1986 | Colliver | 415/214.1 |
| 4,787,818 | 11/1988 | Bales et al. | 415/206 |

FOREIGN PATENT DOCUMENTS

| | | | |
|---|---|---|---|
| 1071888 | 12/1959 | Fed. Rep. of Germany | 415/209 |
| 0035405 | 3/1979 | Japan | 415/127 |
| 1373895 | 2/1988 | U.S.S.R. | 415/206 |

*Primary Examiner*—Edward K. Look
*Assistant Examiner*—Christopher M. Verdier
*Attorney, Agent, or Firm*—Krass & Young

[57] ABSTRACT

A centrifugal fan including a fan wheel and a driveshaft for rotating the wheel in a housing. The fan wheel has an axial center and outer edge portions around the radially outermost extremities. The housing is formed of right and left unitary housing halves of the same size and shape. The housing halves each form a sidewall of the housing and a portion of a circumferential wall of the housing. The housing halves are joined directly to one another to form the housing. The housing has a suction inlet in one of the right and left housing halves at the axial center of the wheel and a fan outlet formed by the housing. The outlet has a center line that is located generally on a radius extending from the axial center of the fan wheel. A chamber for the fan wheel is formed in the housing. A baffle is rigidly connected to the housing and is located in the housing adjacent the side of the fan outlet towards which the fan wheel rotates. The baffle extends into the chamber and terminates at a point outside but adjacent to the path of rotation of outer edge portions of the fan wheel. The baffle is arranged at a substantially acute angle to the center line of the outlet.

20 Claims, 4 Drawing Sheets

FAN CASING

BACKGROUND OF THE INVENTION

This invention relates to centrifugal fans which are used for a variety of purposes to provide an air flow.

Centrifugal fans have been known and used for a considerable length of time. Generally they comprise a rotor with a number of impellers or blades mounted in a housing having an inlet for incoming air and an outlet through which the air is driven. The rotor is rigidly mounted to the end of a driveshaft which is turned by a suitable motor. The fan inlet extends through the side of the housing along the axial centre line of the rotor. Generally in known centrifugal fans the outlet or discharge has a centre line which is parallel to a tangent to the circumference of the rotor, which outlet is formed in the circumferential side of the housing. Because of this arrangement, the fan wheel or rotor must rotate in a direction specified by the outlet arrangement. This in effect doubles the size of the inventory that must be maintained in order to provide centrifugal fans that rotate either counter clockwise or clockwise. Although fan "handing" is achievable by conventional means with this type of fan, rotation modification to an existing unit is not achievable.

In order to produce the known centrifugal fan housings from a plastics material, it is necessary to have two separate moulding units, one for each of the two halves that make up the housing. This requirement arises from a fact that the two halves are not identical, particularly when the centre line of the outlet is parallel to a tangent of the rotor circumference. As these moulds are reasonably expensive, it is desirable, if possible to construct the fan housing using identical mould halves and the present invention permits such a construction.

U.S. Pat. No. 3,797,961 which issued Mar. 19, 1974 to H. Brechbuhl describes a centrifugal fan having a rotor rotated by a driveshaft which extends through the side of the housing. The rotor is made from a plastics material and is connected at the side to a support plate which is connected to the driveshaft. The housing is made of three detachable portions including two side portions and a peripheral housing portion. A large inlet opening is formed in one of the side portions, this being in the portion opposite the driveshaft side. A fan outlet is formed in the peripheral housing portion.

Earlier U.S. Pat. No. 3,301,472 issued Jan. 31, 1967 to American Radiator & Standard Sanitary Corporation describes a blower for moving air which has a scroll or housing 12 and a blower wheel. The blower is of the centrifugal type and is made with two parts, one of which is a substantially flat plate. The other part is made from moulded plastic. The peripheral walls are arcuate and preferably have spiral projections. The axial width of the peripheral walls smoothly and continuously increases along the arcuate direction towards the outlet. The blower wheel is an integral structure including an axial or hub portion and a plurality of vane portions radially extending from the axial portion. Each vane includes a pair of blades that laterally extend from the vane plane.

It is an object of the present invention to provide a simple and relatively inexpensive construction for a centrifugal fan and one which permits the direction of rotation of the fan to be in either direction while using the same fan housing components.

It is another object of the invention to provide a centrifugal fan wherein the fan outlet formed by the housing has a centre line which is located generally on a radius extending from the axial centre of the fan wheel. This results in the centre line of the outlet being in the same plane as the centre line of the axial inlet for the fan. With such an arrangement, the design and construction of air duct systems employing fans of this type is easier.

SUMMARY OF THE INVENTION

According to the invention, a centrifugal fan comprises a fan wheel, means for rotating this fan wheel and a housing for the fan wheel. The fan wheel has an axial centre and outer edge portions around the radially outermost extremities. The housing is formed of right and left unitary housing halves of generally the same size and shape. The housing halves each form a sidewall of the housing and one half of a circumferential wall of the housing. The housing halves are joined directly to one another to form the housing. Preferably, the right and left housing halves are moulded from plastics material in the same mould. There is a suction inlet in the housing at the axial centre of the fan wheel and a fan outlet formed by the housing. The centre line of the outlet is located generally on a radius extending from the axial centre of the fan wheel. A chamber for the fan wheel is formed in the housing. A baffle is rigidly connected to the housing and is located in the housing adjacent the side of the fan outlet towards which the fan wheel rotates. The baffle extends into the chamber and terminates at a point outside but adjacent to the path of rotation of outer edge portion of the fan wheel. The baffle is arranged at a substantially acute angle to the centre line of the outlet.

In one preferred embodiment, the fan outlet has a circular transverse cross-section and the baffle is rounded at one end so as to provide a close fit between this one end of the baffle and the interior surface of the outlet.

Further features and advantages will become apparent from the following detailed description taken in conjunction with the accompanying drawings.

DETAILED DESCRIPTION OF PREFERRED EMBODIMENTS

Figure 1:
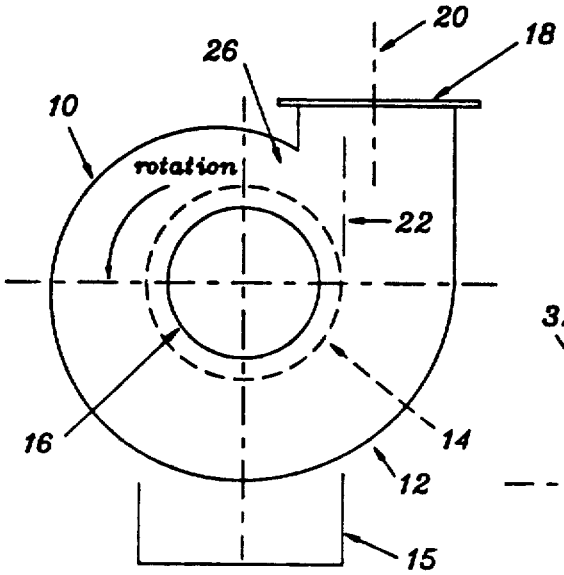
fig 1 prior art
FIG. 1 is a side view of a centrifugal fan (prior art) showing the general shape of the housing.

FIG. 1 of the drawings illustrates a standard centrifugal fan of known construction. This known fan 10 has a fan case or housing 12 in which is rotatably mounted a fan wheel 14 outlined by a dashed line. Low pressure air flows into this fan through an axial fan inlet 16 and air flows out of the fan through an outlet 18. It will be noted that the centre line of the outlet 18 indicated at 20 is parallel to a tangent 22 to the circular circumference of the fan wheel. Also in typical fashion the chamber in which the fan wheel 14 is mounted forms a volute whose cross-section increases from the location at 26 to the outlet 18 in the direction of rotation of the fan wheel (indicated by the arrow A). In order to provide this volute, typically the housing or case 12 is made from two halves which join together at the transverse centre of the housing. Because these two halves are necessarily different in shape, two separate mould units are required to make these halves.

Figure 2:
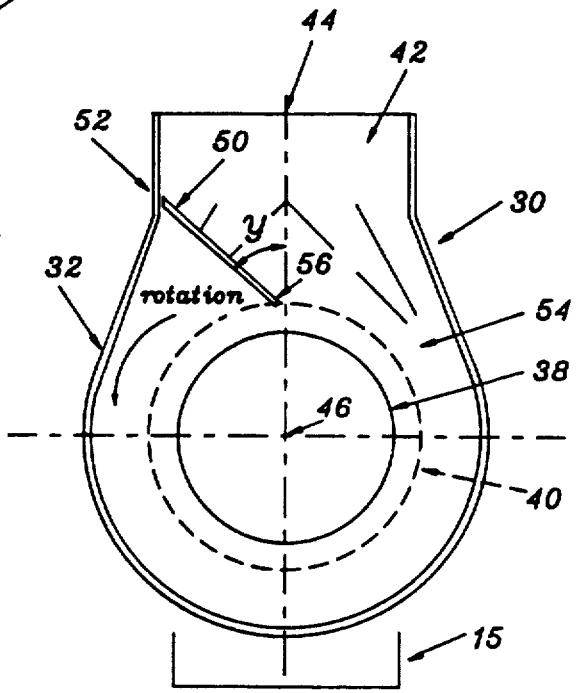
FIG. 2 is a cross-sectional side view of a centrifugal fan constructed in accordance with the present invention and having a round outlet, said view omitting details of the fan blades for ease of illustration.

FIG. 2 is a schematic illustration of a centrifugal fan constructed in accordance with the present invention. This fan 30 is mounted on a base 15 in the same manner as the known fan 10. The fan has a housing or case 32 which is made from right and left housing halves 34, 36 of the same size and shape when they are formed in a moulding unit. Each half 34,36 forms a sidewall of housing 32 and a portion of the circumferential wall of housing 32. As in the prior art fan, there is a suction inlet 38 in a side of the housing 32 at the axial centre of the fan wheel 40. The fan wheel which can be made of plastics material is of standard construction and is rotated by a driving-shaft as explained hereinafter. A round fan outlet 42 or spigot formed by the housing has its centre line indicated at 44 located generally on a radius extending from the axial centre 46 of the fan wheel. A feature of this fan is the provision of a baffle 50 rigidly connected to the housing and located in the housing adjacent the side 52 of the fan outlet towards which the fan wheel 40 rotates. This baffle 50 extends into a chamber 54 formed in the housing for the fan wheel and terminates at a point 56 outside but adjacent to the path of rotation of outer edge portions of the fan wheel. As shown clearly in FIG. 2, the baffle 50 is arranged at a substantial acute angle Y to the centre line of the outlet 42.

Figure 3:
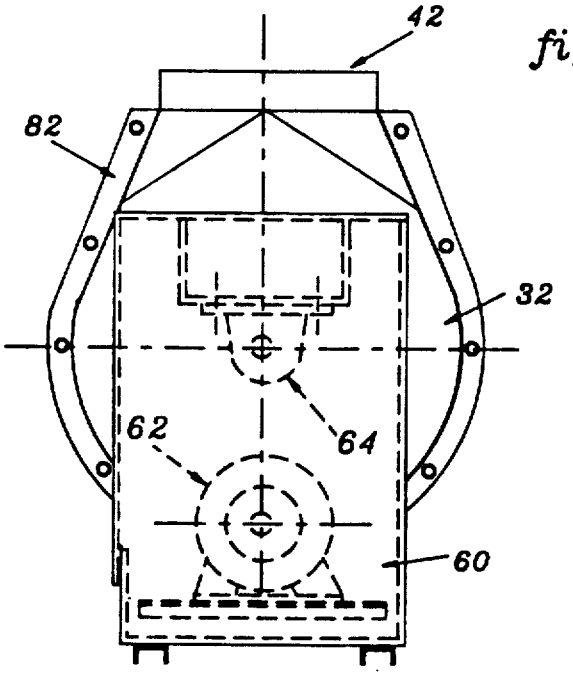
FIG. 3 is a side view of a centrifugal fan constructed in accordance with the invention, this view being taken from the driving-shaft side of the fan housing.
Figure 4:
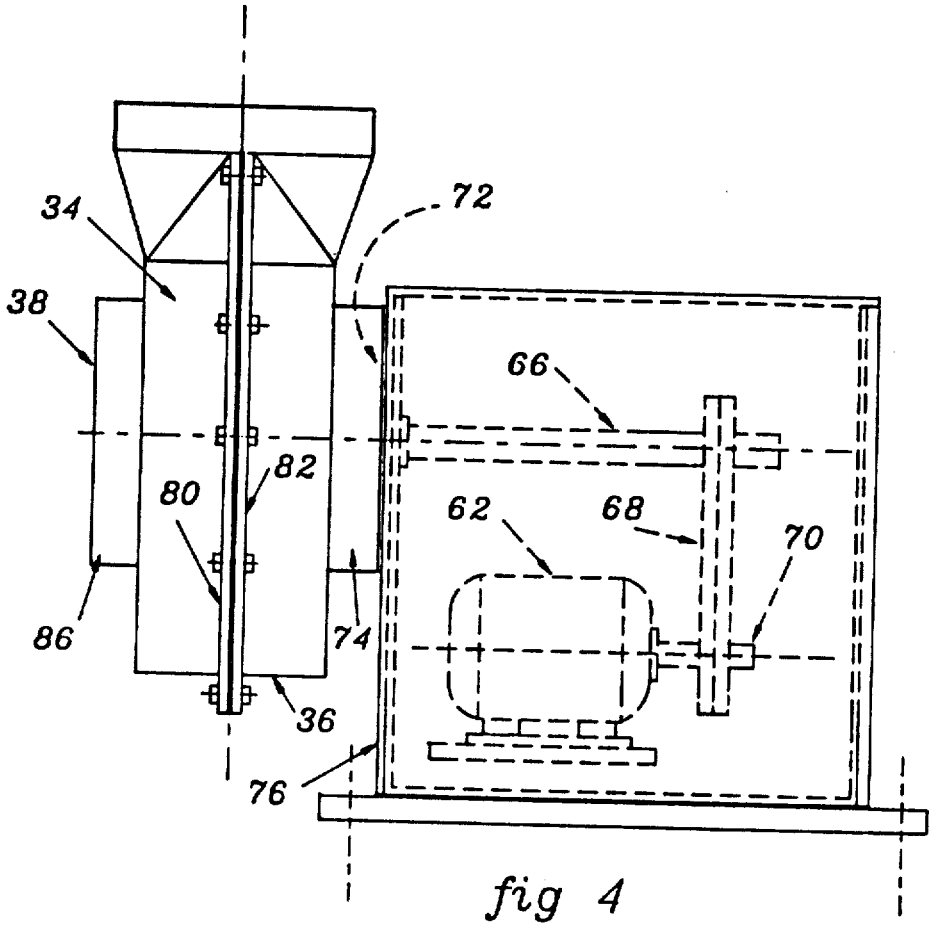
FIG. 4 is a side elevation taken from the lefthand side of FIG. 3 and illustrating in dash-lines a typical drive mechanism for a centrifugal fan.

FIGS. 3 and 4 illustrate in more detail a preferred construction of the fan housing and the means for rotating the fan wheel mounted in this housing. The fan housing 32 is connected to the side of a drive motor housing 60 which contains a drive motor such as an electric motor 62. A driving-shaft is rotatably mounted in the upper portion of the housing 60 in suitable bearings, one of which is indicated in dash-lines at 64 in FIG. 3. The driving-shaft 66 is connected to the motor by means of one or two fan belts 68. These belts extend around two pulleys (not shown) mounted on the driving-shaft 66 and a motor shaft 70. The shaft 66 extends through an opening in the side of the motor housing and through a suitable opening cut in a circular wall 72 of the housing half 36. The circular wall 72 is connected to the side 76 of the motor housing in any suitable manner such as by bolts or screws (not shown).

The two halves 34 and 36 are preferably connected together by radially outwardly extending flanges 80 and 82 which are located along inner edges of the housing halves. As can be seen from FIG. 3, each of these flanges extends about the periphery of the housing half except for the region of the outlet 42. With the construction of FIGS. 3 and 4, the suction inlet for the fan 30 is located in the left half 34, that is, the side opposite the side through which the driveshaft 66 extends. The half 34 is provided with a round section 86 of the same size and construction as a section 74 of the housing half 36. The suction inlet at 38 preferably is formed by cutting away completely the circular wall that intially covers the inlet opening (see the description of FIG. 7 below) when the housing half 34 is formed. Any suitable form of known duct connection be used to connect an adjacent inlet duct (not shown) to the fan housing.

Figure 5:
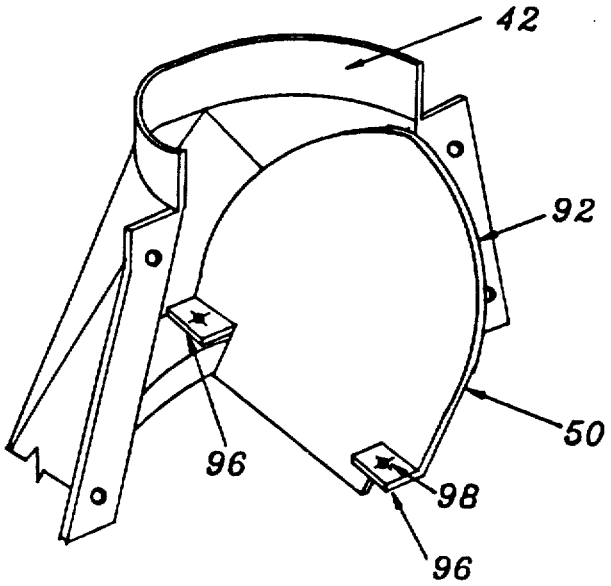
FIG. 5 is a schematic perspective view illustrating a round fan outlet and a baffle unit for use in said outlet.

FIG. 5 illustrates in detail the construction of a baffle member 50 used when the outlet 42 has a circular cross-section as shown. The baffle is rounded at the end 92 so as to provide a close fit between this one end of the baffle and the interior surface of the outlet indicated at 94 in the embodiment of FIGS. 6 and 7.

The baffle 50 has two connecting tabs 96 formed on opposed edge portions thereof. To provide the required angle to the baffle 50, the tabs 96 extend at an angle to the plane of the flat baffle 50. The tabs can be provided with a screw or bolt hole 98 and can be detachably connected to shoulders 100 formed in each housing half (see FIG. 7).

Figure 6:
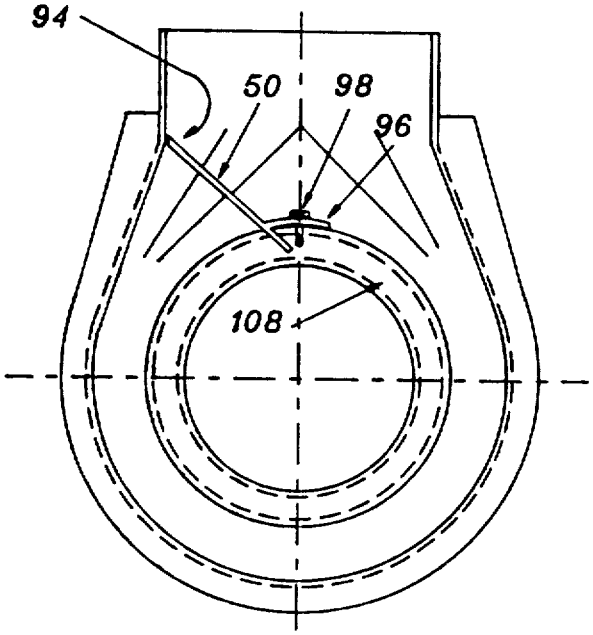
FIG. 6 is a side view in cross-section of a centrifugal fan constructed in accordance with the invention, said fan having a round outlet.
Figure 7:
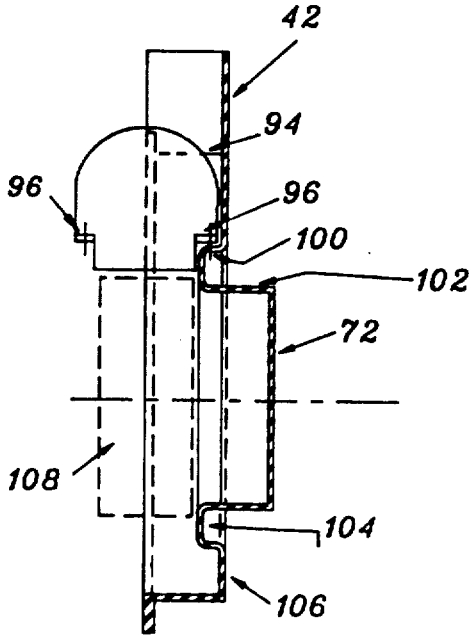
FIG. 7 is a cross-sectional view of a housing half prior to being cut open at its centre and showing the position of the impeller or fan wheel in dashed lines only.

In the embodiment of FIGS. 6 and 7, each housing half has a cylindrical central section 102 which forms a suction inlet in one of the halves. Extending radially outwardly from the inner end of this section is a short circular side section 104 which is connected to a further side section 106 by the aforementioned shoulder 100. The fan wheel 108 of this version has an external diameter slightly larger than the inlet opening formed by the section 102.

FIG. 7 illustrates the axial cross-section of each housing half after it leaves the mould. The half has a complete circular sidewall 72 which is cut away entirely in that half that is used for the axial inlet for the fan.

FIGS. 9 to 16 of the drawings illustrate various configurations that can be achieved with traditional centrifugal fan casings. It will be noted that in each case the outlet 18 has its centre line-offset from the centre line of the axial inlet 16. This arrangement necessitates that the outlet duct connected to the outlet 18 be located in a different plane than that in which the inlet duct is located. Because of this, extra time and expense can be required to design and construct an airflow system employing such a centrifugal fan.

FIGS. 16 to 23 clearly illustrate the advantage that can be achieved with the fan constructed in accordance with the present invention. In this case, no matter what the rotation of the fan housing, the outlet 42 has its centre line always located on a plane that extends through the axial centre of the inlet 38. This simplifies the design and construction of an airflow system which employs a fan constructed in accordance with the invention. The designer and contractor need not allow for any offset distance between the inlet duct and the outlet duct.

Figure 8:
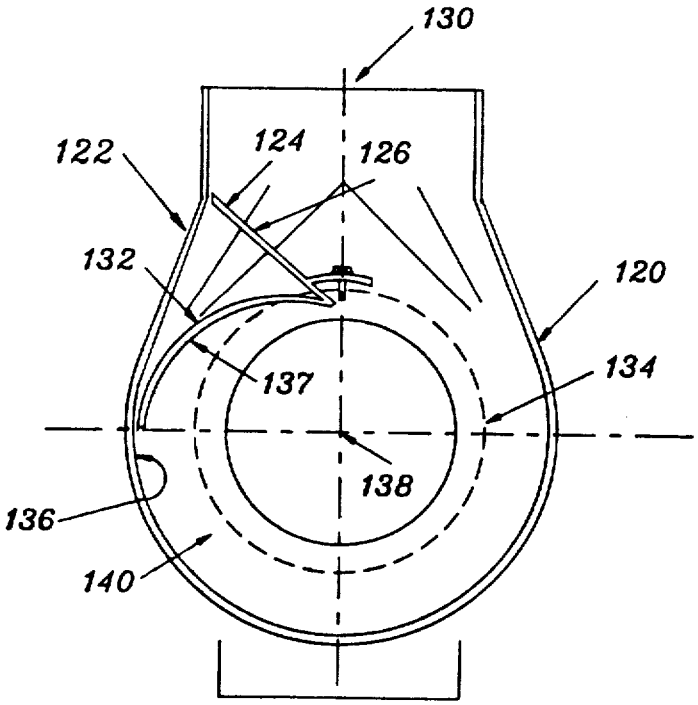
FIG. 8 is a cross-sectional side view of another embodiment of a fan constructed in accordance with the invention.
Figure 9:
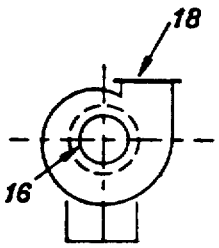
FIGS. 9 to 16 are schematic illustrations showing a traditional fan casing configuration and the position of the fan outlet as the fan casing is rotated through increments of forty-five degrees.
Figure 10:
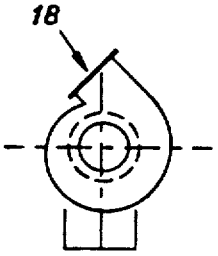
Figure 11:
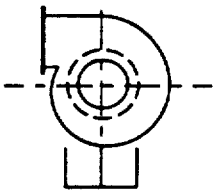
Figure 12:
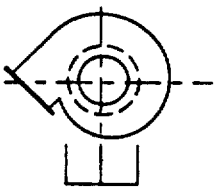
Figure 13:
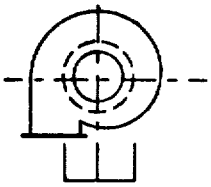
Figure 14:
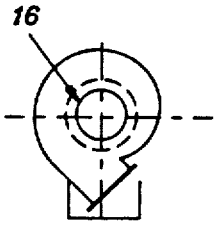
Figure 15:
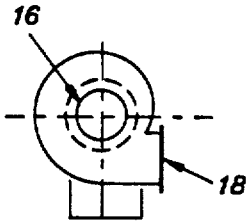
Figure 16:
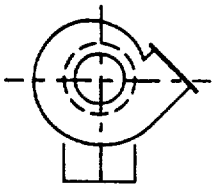
fig 16 prior art
Figure 17:
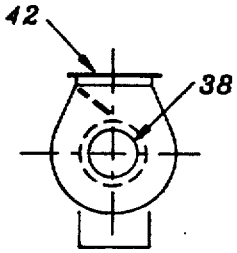
FIGS. 17 to 24 are schematic illustrations of a centrifugal fan constructed in accordance with the present invention showing the position of the outlet as the fan casing is rotated in increments of forty-five degrees.
Figure 18:
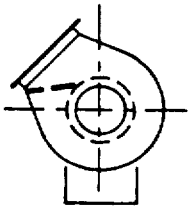
Figure 19:
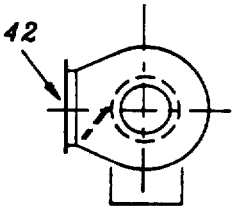
Figure 20:
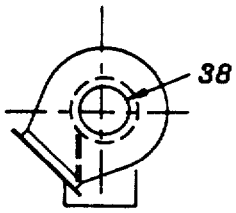
Figure 21:
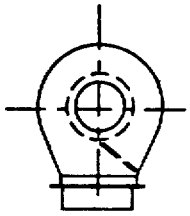
Figure 22:
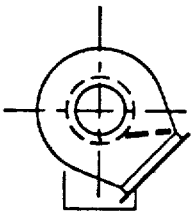
Figure 23:
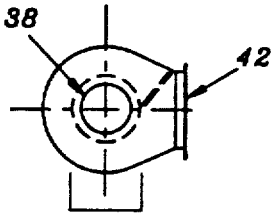
Figure 24:
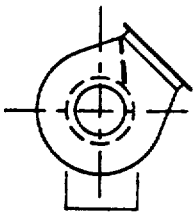

FIG. 8 schematically illustrates an alternative version of a baffle that can be used in a centrifugal fan constructed in accordance with the invention. In this fan unit 120, the two housing halves that make up the housing 122 can be constructed in substantially the same manner as those used in the embodiments of FIGS. 2 to 7. The fan is equipped with a baffle member 124 which can be attached to the inside of the housing in the same manner as the baffle 50 shown in FIGS. 5 to 7. However this baffle member 124, in addition to having a flat plate 126 arranged at an acute angle to the centre line of the outlet 130, has a curved plate 132 that extends in the direction of rotation of the fan wheel 134 from the end of the flat plate closest to the fan wheel to the inner circumferential surface 136 of the chamber. The curved plate is arranged to form an inner surface 137 whose distance from the centre 138 of the fan wheel increases in the direction of rotation of the fan wheel. Thus a form of volute 140 is formed in the housing chamber in which the fan wheel is rotatably mounted.

It should also be noted that although only a flat plate has been shown for the baffle 50 and the plate member 126 in FIG. 8, this plate could be curved to some extent if desired. The concave side of the curved plate would face towards the outlet of the fan.

As has been noted previously, the two housing halves that make up the fan housing are initially identical in size and shape, that is, they are substantially the same when they are intially formed. However it is generally necessary to modify one or both of these halves prior to completion of the fan housing in order that one of the halves can provide an opening for a driving-shaft. The differences between the two halves is caused by cutting away the required portion of a circular sidewall or other sidewall portion as required. It will be understood by those skilled in the art that any reference herein to these halves being the same or substantially the same is to be read as an indication of the initial condition of the two halves before they are altered to serve their particular function in the completed fan housing.

It will also be clear to those skilled in the art that various modifications and changes could be made to the centrifugal fan described herein without departing from the spirit and scope of this invention. Accordingly all such modifications and changes as fall within the scope of the appended claims are intended to be part of this invention.

I therefore claim:

1. A centrifugal fan comprising:

a fan wheel having an axial centre and outer edge portions around radially outermost extremities of the fan wheel, said wheel being rotatable in a predetermined direction;

means for rotating said fan wheel;

a housing for said fan wheel, said housing being formed of right and left unitary housing halves of substantially the same size and shape, said housing halves each forming a sidewall of the housing and a portion of a circumferential wall of the housing, said two halves being rigidly joined directly to one another to form the housing;

a suction inlet formed in one of said right and left housing halves at the axial centre of said fan wheel;

a fan outlet formed by sad housing and having a centre line located generally on a radius extending from the axial centre of said fan wheel;

a chamber for said fan wheel and said chamber being formed in said housing; and a baffle rigidly connected to each of said housing halves and located in said housing adjacent a side of said fan outlet towards which said fan wheel rotates, said baffle extending into the chamber and said baffle terminating at a point outside but adjacent to a path of rotation of said outer edge portions of said fan wheel, wherein said baffle is arranged generally at an acute angle to the centre line of said outlet.

2. A centrifugal fan according to claim 1 wherein said fan outlet has a circular transverse cross-section, and an interior surface and said baffle has a first end portion which is rounded so as to provide a close fit between said first end portion of said baffle and the interior surface of said outlet.

3. A centrifugal fan according to claim 2 wherein said baffle has opposed edge portions and two connecting tabs formed on said opposed edge portions, said fan outlet has opposite sides, and each of said housing halves has a shoulder formed therein located on said opposite sides of the fan outlet, said tabs being detachably connected to the shoulders.

4. A centrifugal fan according to claim 3 wherein opposed edge portions of said baffle are bolted to said housing.

5. A centrifugal fan according to claim 3 wherein said housing halves are each formed with a radially outwardly extending flange along an inner edge thereof and said two flanges are bolted to one another.

6. A centrifugal fan according to claim 1 wherein the chamber has an inner surface and said baffle comprises a flat plate having a first end portion which is closest to the fan wheel, said plate being arranged at said acute angle to the centre line of said outlet and wherein a curved plate extends in the predetermined direction of rotation of said fan wheel from said first end portion of said flat plate to said inner surface of said chamber, said curved plate being arranged to form an inner surface whose distance from the centre of said fan wheel increases in the direction of rotation of said fan wheel.

7. A centrifugal fan according to claim 1 wherein said housing halves are each moulded from plastics material in the same mould.

8. A centrifugal fan according to claim 3 wherein said rotating means comprises a driving-shaft connected at one end to said fan wheel and extending through the other of said right and left housing halves.

9. A centrifugal fan according to claim 2 wherein said housing halves are each moulded from plastics material in the same mould.

10. A centrifugal fan according to claim 6 wherein said housing halves are each moulded from plastics material in the same mould.

11. A centrifugal fan according to claim 3 wherein the chamber has an inner surface and said baffle comprises a flat plate having a first end portion and said plate being arranged at said acute angle to the centre line of said outlet and wherein a curved plate extends in the direction of rotation of said fan wheel from said first end portion of said flat plate closest to said fan wheel to said inner surface of said chamber, said curved plate being arranged to form an inner surface whose distance from the centre of said fan wheel increases in the direction of rotation of said fan wheel.

12. A centrifugal fan according to claim 1 wherein said rotating means comprises a driving-shaft connected at one end to said fan wheel and extending through the other of said right and left housing halves.

13. A centrifugal fan comprising:

a fan wheel having an axial centre, and outer edge portions around radially outermost extremities of the fan wheel, said wheel being rotatable in a predetermined direction, means for rotating said fan wheel;

a housing for said fan wheel, said housing being formed of right and left unitary halves of substantially the same size and shape, said right and left housing halves being moulded from plastics material from a same mould;

suction inlet formed in one of said right and left housing halves at the axial centre of said fan wheel;

a fan outlet formed by said housing and having a centre line located generally on a radius extending from the axial centre of said fan wheel;

a chamber for said fan wheel and said chamber being formed in said housing; and a baffle rigidly connected to each of said housing halves and located in said housing adjacent a side of said fan outlet towards which said fan wheel rotates, said baffle extending into the chamber and said baffle terminating at a point outside but adjacent to a path of rotation of said outer edge portions of said fan wheel, wherein said baffle is arranged generally at an acute angle to the centre line of said outlet.

14. A centrifugal fan according to claim 13 wherein said fan outlet has a circular transverse cross-section and an interior surface and said baffle has a first end portion which is rounded so as to provide a close fit between said first end portion of said baffle and the interior surface of said outlet.

15. A centrifugal fan according to claim 14 wherein said baffle has opposed edge portions and two connecting tabs formed on said opposed edge portions, said fan outlet has opposite sides, and each of said housing halves has a shoulder formed therein located on said opposite sides of the fan outlet, said tabs being detachably connected to the shoulders.

16. A centrifugal fan according to claim 14 wherein said housing halves are each formed with a radially outwardly extending flange along an inner edge thereof and said two flanges are bolted to one another.

17. A centrifugal fan according to claim 13 wherein the chamber has an inner surface and said baffle comprises a flat plate having a first end portion which is closest to the fan wheel, said plate being arranged at said acute angle to the centre line of said outlet and wherein a curved plate extends in the predetermined direction of rotation of said fan wheel from said first end portion of said flat plate to said inner surface of said chamber, said curved plate being arranged to form an inner surface whose distance from the centre of said fan wheel increases in the direction of rotation of said fan wheel.

18. A centrifugal fan according to claim 15 wherein the chamber has an inner surface and said baffle comprises a flat plate having a first end portion which is closest to the fan wheel, said plate being arranged at said acute angle to the centre lien of said outlet and wherein a curved plate extends in the predetermined direction of rotation of said fan wheel from said first end portion of said flat plate to said inner surface of said chamber, said curved plate being arranged to form an inner surface whose distance from the centre of said fan wheel increases in the direction of rotation of said fan wheel.

19. A centrifugal fan according to claim 13 wherein said rotating means comprises a driving-shaft connected at one end to said fan wheel and extending through the other of said right and left housing halves.

20. A centrifugal fan according to claim 15 wherein said rotating means comprises a driving-shaft connected at one end to said fan wheel and extending through the other of said right and left housing halves.

* * * * *